United States Patent [19]

Iriarte

[11] 4,058,159

[45] Nov. 15, 1977

[54] HEAT PIPE WITH CAPILLARY GROOVE AND FLOATING ARTERY

[75] Inventor: Wilfrido R. Iriarte, Long Beach, Calif.

[73] Assignee: Hughes Aircraft Company, Culver City, Calif.

[21] Appl. No.: 630,236

[22] Filed: Nov. 10, 1975

[51] Int. Cl.[2] ..... F28D 15/00

[52] U.S. Cl. ..... 165/105; 165/133; 29/157.3 R

[58] Field of Search ..... 165/133, 105

[56] References Cited

U.S. PATENT DOCUMENTS

| | | | |
|---|---|---|---|
| 3,844,342 | 10/1974 | Eninger et al. | 165/105 |
| 3,865,184 | 2/1975 | Grover | 165/105 |
| 3,892,273 | 7/1965 | Nelson | 165/105 |
| 4,020,898 | 5/1977 | Grover | 165/105 |

FOREIGN PATENT DOCUMENTS

| | | | |
|---|---|---|---|
| 2,403,538 | 8/1974 | Germany | 165/105 |

*Primary Examiner*—Albert W. Davis, Jr.
*Attorney, Agent, or Firm*—Lewis B. Sternfels; W. H. MacAllister

[57] ABSTRACT

A multi-spline tool cuts material from the interior wall of a heat pipe envelope to provide a path for working fluid flow. Cross cuts can be made by pulling the tool out of the same end from which it was inserted while the tool continues to rotate in the same direction. An unrestrained liquid supply artery configured, for example as a cylinder of perforated metal, wire screen material, or other porous substance, with a designed flow area is inserted in the envelope. Since the artery is unrestrained, that is, not attached to the envelope, in a gravity field it will drop to the lower portion of the envelope inside diameter to assure a liquid flow at the bottom of the tube, regardless of the orientation of the heat pipe.

11 Claims, 3 Drawing Figures

HEAT PIPE WITH CAPILLARY GROOVE AND FLOATING ARTERY

BACKGROUND OF THE INVENTION

1. Field of the Invention

The present invention relates to means and method for extending the inner surface of a heat pipe envelope and for assuring return of condensate regardless of the orientation of the heat pipe.

2. Description of the Prior Art

A heat pipe may be defined simply as an elongated enclosure, which is sealed from the external environment, and which contains a working fluid. The working fluid is adapted to evaporate at a hot end of the enclosure, to move as a vapor to the colder end of the enclosure, to condense at the colder end, and to flow back to the hotter end of the enclosure.

In order to provide for efficient operation of the heat pipe, it is necessary that the interior surface of the envelope include a wick, such as of sintered material, grooves, and the like. Such wicking has a single or double function. One function is to permit efficient circumferential wicking at the evaporation end of the envelope to distribute as much working fluid as possible about the inner pipe surface for purposes of evaporation. Its other function is to act as a conduit for supply of condensed liquid from the condensation end to the evaporation end of the envelope. This latter function is particularly important to prevent condensed liquid from being in the path of the vapor and vice-versa. Specifically, it is preferable that the evaporated vapor move down the center of the envelope while the condensate return along the exterior portions thereof so as to form a unidirectional toroidal motion and to prevent one from interferring with the other. In general, the provision of means to accomplish such uninterrupted vapor-condensate flow results in a relatively expensive construction. It is, in part, for this reason specially formed that grooves have been placed in interior walls (e.g., U.S. Pat. No. 3,753,364) and partitions have been used with such grooves (e.g., U.S. Pat. No. 3,865,184). In other systems, special material handling and sintering operations are required which involve considerable expense.

SUMMARY OF THE INVENTION

The present invention overcomes these and other problems by providing for substantially radial, random scoring on the interior surface of a heat pipe envelope with the addition of a floating artery which rests at the bottom of the tube at all times under the influence of gravity.

It is, therefore, an object of the present invention to provide for an inexpensive heat pipe.

Another object is to provide for an easily fabricated heat pipe.

Another object is to provide for a heat pipe which does not require a particular orientation of the heat pipe.

Other aims and objects as well as a more complete understanding of the present invention will appear from the following explanation of an exemplary embodiment and the accompanying drawings thereof.

DESCRIPTION OF THE PREFERRED EMBODIMENT

Figure 1:
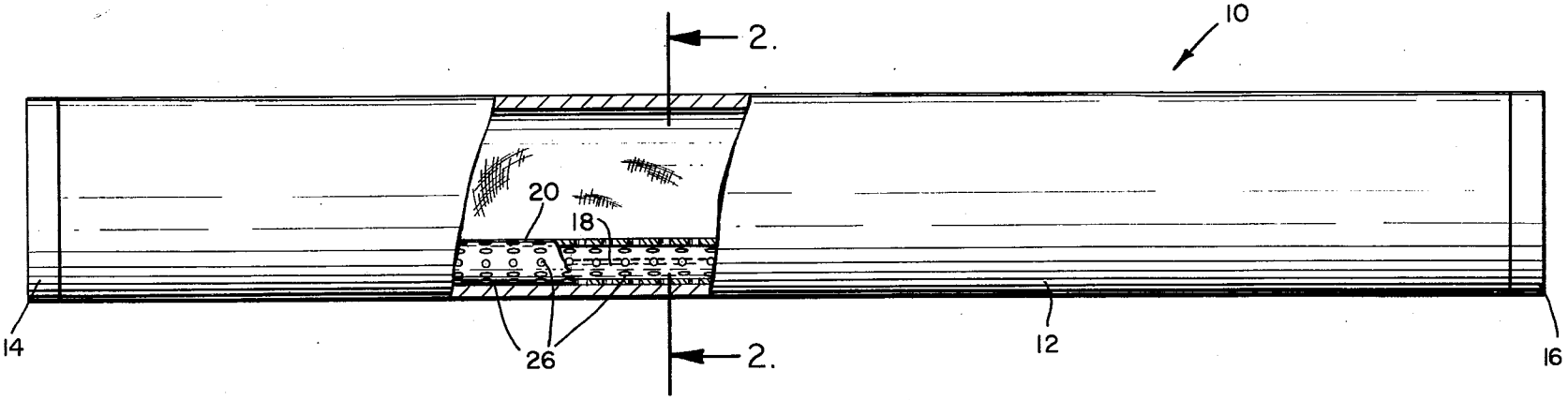
FIG. 1 is a view of a heat pipe with a portion thereof partially cut away to show the interior thereof.

Accordingly, a heat pipe 10 comprises an envelope 12 which is sealed at both ends 14 and 16 to provide for a completely enclosed system. Inserted within the heat pipe is a working fluid 18 and a free floating artery 20 which is designed to rest at the lower portion of the interior surface 22 of the heat pipe under the influence of gravity. The interior of the heat pipe is scored with substantially radial, criss-crossing grooves or scoring marks 24.

Figure 3:
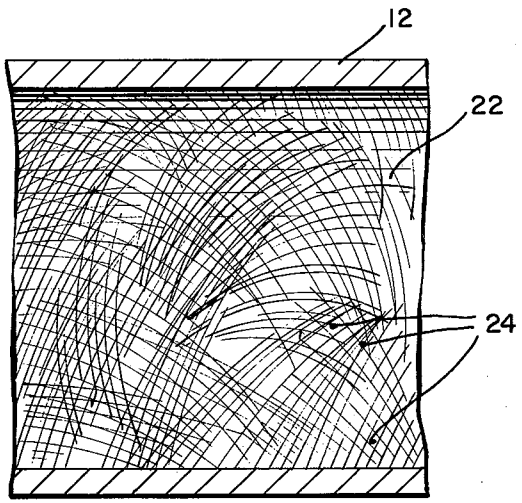
FIG. 3 is an enlarged view of a section of the heat pipe of FIG. 1 showing the substantially radial, random and crisscrossing scoring of the interior wall surface thereof.

The formation of such scoring 24 may be made in any convient manner. The preferred method involves the insertion of a multi-spline device or tool which cuts or removes the material from the interior wall 24 to provide a path for liquid flow of working 18. Due to the shallow depth and width of the cuts, multiplicity of cuts can be made, as illustrated in FIG. 3. A cross-cut configuration, as also shown in FIG. 3, can be made by pulling the tool out of the same end from which it was inserted while the tool continues to rotate in the same direction. Such cutting or scoring multiplies the possibilities of liquid flow to provide circumferential wicking and increased evaporation of fluid from the hotter end of the heat pipe.

Cutting of the material of envelope 12 is preferably accomplished by bonding a hardened cutting tip, such as of silicon carbide, boron carbide, r aluminum oxide, on a brush type multi-tip tool, or by utilizing a permanent or replaceable, adjustable or stationary multi-cutting tool.

Because the cutting of tube interior 22 is circumferential and, therefore, symmetrical, unrestrained liquid supply artery 20 with a designed flow area can be inserted in envelope 12 for either the complete or a partial length of the tube. Of importance, it must be placed in the condenser portion of heat pipe 10 and extend at least partially into the evaporation section. It acts as a shield for preventing condensed liquid from being in the path of the vapor, and viceversa.

Figure 2:
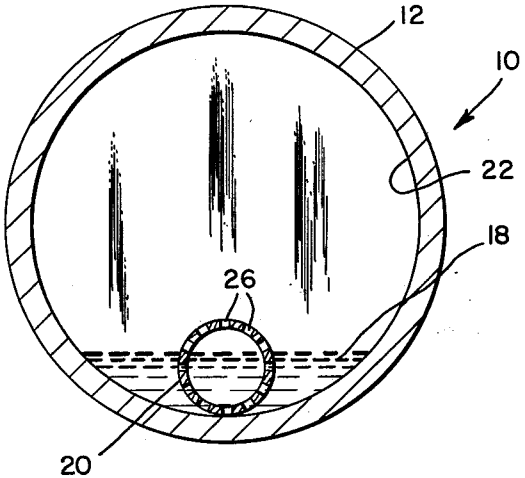
FIG. 2 is a cross sectional view of the heat pipe depicted in FIG. 1 taken along lines 2—2 thereof.

Since the artery is unrestrained, that is, it is unsecured to envelope 12 and is freely moveable therein, within a gravity field it will drop to the lowest portion of the tube inside diameter for assuring a liquid flow path at the bottom of the heat pipe, as shown in FIGS. 1 and 2.

Preferrably, artery 20 is made of a perforated metal sheet which may be rolled into a cylinderical or tubular fashion so as to provide a plurality of perforations or holes 26 therein. Perforations 26 are used to permit artery 20 to breath and to prevent any accidental entrapment of bubbles therein which otherwise might block the free flow of liquid. Alternate materials include wire screen and porous substances.

Although the invention has been described with reference to particular embodiments thereof, it should be realized that various changes and modifications may be made therein without departing from the spirit and scope of the invention.

What is claimed is:

1. A heat pipe comprising an envelope sealed and closed from the environment external to said envelope, means for defining a working fluid therein for condensing and evaporating at opposed ends of said envelope, and means for defining an artery in said envelope and extending freely in an unconnected, thermally contacting manner through substantially the entire length of said envelope for conducting condensations of said working fluid from said condensing end to said evaporating end, said artery means including an exterior surface with means therein extending throughout the length of said artery means for enabling passage of said working fluid through said entire external surface.

2. A heat pipe as in claim 1 wherein said artery means comprises a cylinder having means along its length for defining perforations therein.

3. A heat pipe as in claim 1 wherein said artery means comprises a screen.

4. A heat pipe as in claim 1 wherein said artery means comprising porous material.

5. A heat pipe as in claim 1 wherein said envelope is provided with an interior surface and is disposed to lie substantially parallel to the force of gravity, and wherein said artery means rests on the bottom of the interior surface by gravity for assuring a flow path for the condensations.

6. A heat pipe as in claim 1 further including means for defining randomly scored, criss-crossing, substantially radial extending grooves on the interior surface of said envelope for providing a wicking path for adequately distributing the working fluid in said evaporating end.

7. A heat pipe as in claim 6 wherein said envelope comprises a cylindrical tube having a diameter and said artery means comprises a porous cylinder of lesser diameter than that of said cylindrical tube, said porous cylinder resting on the bottom of said interior surface under gravity, regardless of the orientation of the tube, for assuring a flow path at the bottom of said tube for the condensations.

8. A heat pipe as in claim 7 wherein said porous cylinder comprises a perforated metal sheet rolled into a cylindrical configuration.

9. A heat pipe as in claim 1 an interior surface in said envelope, and means in said surface for defining substantially radial random grooves.

10. A heat pipe as in claim 9 wherein said groove means include random, criss-crossing grooves.

11. A heat pipe as in claim 9 wherein said free-floating artery rests on said surface under the influence of gravity.

* * * * *